US009783947B2

(12) United States Patent
Lee

(10) Patent No.: US 9,783,947 B2
(45) Date of Patent: Oct. 10, 2017

(54) SUBMERGED OIL STORAGE, LOADING AND OFFLOADING SYSTEM

(71) Applicant: William Wei Lee, Shanghai (CN)

(72) Inventor: William Wei Lee, Arcadia, CA (US)

( * ) Notice: Subject to any disclaimer, the term of this patent is extended or adjusted under 35 U.S.C. 154(b) by 0 days.

(21) Appl. No.: 14/979,448

(22) Filed: Dec. 27, 2015

(65) Prior Publication Data

US 2017/0183835 A1 Jun. 29, 2017

(51) Int. Cl.

| | |
|---|---|
| ***E21B 7/136*** | (2006.01) |
| ***E21B 15/02*** | (2006.01) |
| ***E02B 17/02*** | (2006.01) |
| ***E02B 17/00*** | (2006.01) |
| ***B65D 88/16*** | (2006.01) |
| ***B65D 88/22*** | (2006.01) |
| ***B65D 88/78*** | (2006.01) |
| ***B65D 88/54*** | (2006.01) |
| ***B65D 90/04*** | (2006.01) |

(Continued)

(52) U.S. Cl.

CPC ..... *E02B 17/02* (2013.01); *B65D 88/16* (2013.01); *B65D 88/22* (2013.01); *B65D 88/54* (2013.01); *B65D 88/74* (2013.01); *B65D 88/78* (2013.01); *B65D 90/046* (2013.01); *B65D 90/12* (2013.01); *E02B 17/003* (2013.01); *E21B 7/136* (2013.01); *E21B 15/02* (2013.01); *E02B 2017/0056* (2013.01)

(58) Field of Classification Search

CPC ..... E21B 7/136; E21B 15/02; E02B 17/003; E02B 17/02; B65D 88/16; B65D 88/22; B65D 88/54; B65D 88/74; B65D 88/78; B65D 90/046; B65D 90/12; B63B 35/44

See application file for complete search history.

(56) References Cited

U.S. PATENT DOCUMENTS 3,753,494 A * 8/1973 Hirata ..... B65D 88/78 114/257
3,863,457 A * 2/1975 Hafskjold ..... B65D 88/78 405/208

(Continued)

FOREIGN PATENT DOCUMENTS

GB 2280214 A * 1/1995 ..... E02B 17/02
GB 2336384 A * 10/1999

*Primary Examiner* — Matthew R Buck
(74) *Attorney, Agent, or Firm* — Liu Law Group pllc

(57) ABSTRACT

An oil storage, loading and offloading system includes a submerged oil storage tank with multiple vertically placed flexible containers. The system directly connects to the topsides of an offshore oil production platform above water to assist oil loading and offloading operations. During loading, oil is pumped in and stored inside flexible containers, which are expanded to displace equivalent amount of water out of the oil storage tank; during offloading, oil is pumped out from flexible containers and the reduced volume of each contracted container is then filled in by the equivalent amount of water from the surroundings There is no physical contact between water and oil. The submerged tank on-bottom weight has a limited variation during the loading and offloading operations. This disclosed system can be utilized for fixed offshore platforms, especially for shallow water marginal field developments, and for deepwater floating platforms such as SPAR and semi-submersible (SEMI) structures.

27 Claims, 12 Drawing Sheets

(51) Int. Cl.
*B65D 90/12* (2006.01)
*B65D 88/74* (2006.01)

(56) References Cited

U.S. PATENT DOCUMENTS 4,059,065 A * 11/1977 Clark ..... B65D 88/78 114/256
4,141,377 A * 2/1979 Fernandez ..... B65D 88/62 137/236.1
4,190,072 A * 2/1980 Fernandez ..... B65D 88/62 137/236.1
4,200,411 A * 4/1980 Brown ..... E21B 43/01 114/257
6,527,002 B1 * 3/2003 Szakaly ..... B64D 37/06 137/14
7,448,404 B2 * 11/2008 Samuelsen ..... B65D 88/78 137/236.1
8,011,312 B2 * 9/2011 Finn ..... B63B 27/24 114/256
8,905,677 B2 * 12/2014 Hantz ..... B65D 90/48 114/256
9,327,805 B2 * 5/2016 Wang
9,470,365 B1 * 10/2016 Atkinson ..... B65D 88/78
2012/0093587 A1 * 4/2012 Finn ..... B63B 21/50 405/200
2012/0260839 A1 * 10/2012 Maher ..... B65D 90/02 114/257
2014/0301790 A1 * 10/2014 Chitwood ..... B63B 25/12 405/210
2015/0322642 A1 * 11/2015 Wu ..... E02B 17/02 405/8
2016/0023843 A1 * 1/2016 Donahue ..... B65D 88/78 405/210
2016/0186401 A1 * 6/2016 Selwa ..... E21B 43/36 405/205
2016/0207594 A1 * 7/2016 Rijken ..... B63B 35/44

* cited by examiner

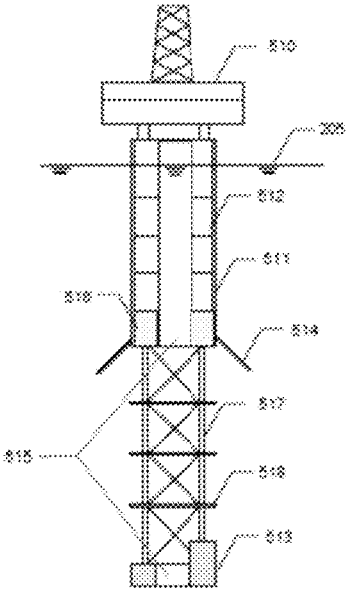
FIG. 14A
(Prior Art)
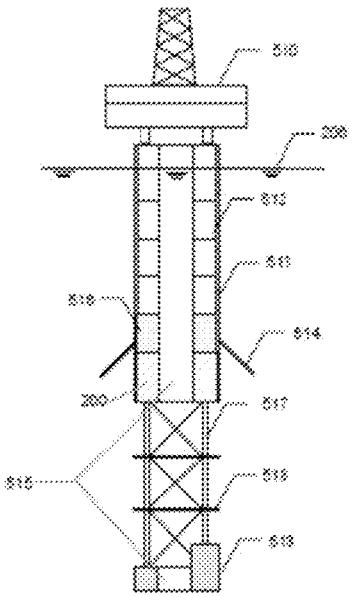
(FIG. 14B)

SUBMERGED OIL STORAGE, LOADING AND OFFLOADING SYSTEM

FIELD OF THE INVENTION

The disclosure relates generally to a liquid storage, loading and offloading system using flexible containers and its associated applications for both fixed offshore oil production platforms and floating oil production platforms.

BACKGROUND OF THE INVENTION

After crude oil is produced from an offshore oil production platform in an oil field, there are two options to deal with the produced oil: 1) export the oil out through a subsea pipeline system; or 2) store the oil in a temporary storage facility, which could be a fixed part of the platform itself or a separate storage facility, and then transport the oil out via an oil shuttle tanker. If the production of the field in terms of quantity or duration is insufficient to justify the cost of a subsea pipeline connecting the platform to the shore, a platform with a safe, reliable and low cost temporary oil storage system must be provided for the development of such a field.

The location of a temporary oil storage system is an important issue. There are only three possible options: 1) build the system above water as a fixed part of the offshore platform's topsides; 2) construct the system at water surface as a part of a floating structure; or 3) build the system under water as a part of the platform substructure or as a separate facility which is usually connected to the platform topsides via pipes for oil loading and offloading operations. Each of these options has pros and cons during its applications. With Option 1, the oil tank is usually built as a fixed part of the topsides commonly beneath the process modules and living quarters. This arrangement makes the tank independent of waves and current-induced environmental loadings. However, placing oil compartments beneath the process modules and living quarters could constitute a serious safety hazards. An even more critical issue is that this arrangement places a large mass at the platform top with a large weight variation during a loading and offloading operation, which could greatly influence the dynamic characteristics of the platform. Therefore, this option has been only used for very shallow water fixed platform applications so far in the offshore industry. With Option 2, it is easy to increase the oil storage capacity of a floating structure such as a ship-shaped FPSO vessel. However, the cost of a floating structure is usually much higher than a conventional fixed platform because the floating structure is subject to a large wind and wave induced environmental loading and it requires an expensive station keeping system to keep the floating structure in location. Therefore, floating structures are usually applied in deep water applications or some shallow water applications where a subsea pipeline system becomes too expensive to be feasible. With Option 3, it is the most preferred method for both offshore fixed platforms and offshore floating structures because the wind induced environmental loading is totally eliminated and the wave induced environmental loading should also be significantly reduced, if the top of the storage tank is sufficiently submerged under water surface. In addition, the platform's vertical center of gravity (COG) should also be lowered, which generally benefits the platform's dynamic characteristics as well as the motion responses. However, a subsea oil storage system usually faces many challenges under different types of applications. One of the most critical challenges is how to handle a large amount of buoyancy and related weight variations during the system's loading and offloading operations.

For a submerged offshore storage system, there are two common methods to store oil or other hydrocarbon liquids underwater. The first one is called "wet storage method". Under this method, oil and seawater are stored together underwater within the same tank. Because of the density difference (crude oil density: ~0.8 to ~0.9), oil or other non-water solvable hydrocarbon liquids should stay at the top of the tank above the seawater and maintain a physical contact surface between the two types of liquids. During a loading operation, an amount of produced oil is imported into the tank and the equivalent amount of seawater, in the volume term, is then displaced to keep the total volume of oil and sea water constant within the tank. During an offloading operation, the process is reversed: seawater is imported into the tank to displace the oil and to keep the total volume constant inside the tank. The first advantage of the wet storage method is that the on-bottom weight at the storage tank bottom should have limited variations, generally only about 15% reduction of the maximum on-bottom weight at the tank bottom between loading and offloading operations. The second advantage of the wet storage method is that the tank does not need to be designed as a pressured vessel because the tank internal pressure is hydrostatically balanced with outside seawater throughout its service life. However, the wet storage method also possesses three major disadvantages. The first disadvantage is the environmental pollution concern. Under the dynamic motions, the contact surface between oil and seawater could produce a mixed layer to cause environmental pollution if discharged out to the sea. The second disadvantage of the wet storage method is the issue of thermal insulation. It is very hard to keep oil warm with the existence of a large contact surface between warm oil and cold seawater. The third disadvantage is that it cannot store water-soluble liquids such as methanol. Because of these critical disadvantages, especially with the environmental pollution concerns, this wet storage method has had very few field applications so far, either for fixed platforms or for floating platforms, in spite of the tremendous efforts made in the offshore industry.

The second common method to store oil or other hydrocarbon liquids underwater is called "dry storage method". Under this method, oil or other hydrocarbon liquids can be simply stored in an underwater storage tank without any contact with sea water. In addition, the underwater storage tank can be easily applied with a good thermal insulation protection to the stored oil. However, this simple dry storage method faces two critical challenges during its service life. The first challenge is the large buoyancy issue due to the emptied room of the tank during an oil offloading process. The second challenge is the inert gas induced environmental pollution concern. In order to prevent the evaporated gas from escaping the oil storage tank to pollute outside air, inert gas is commonly used to be injected into a closed oil storage tank's top part above the oil surface. However, the required inert gas operations such as generating, blanketing and venting could become another source of pollution hazards. To overcome the first challenge of excessive buoyancy, common practice is to use a concrete gravity based platform. The heavy weight of a concrete structure helps to offset the extra buoyancy generated by an oil offloading operation. Another solution for the first challenge is to build extra ballast tanks and to ballast water in during an offloading operation in order to compensate for the discharged oil. Due to the above concerns, so far there have been only a very limited number of field applications, mostly in the form of concrete gravity based platforms, in the offshore oil & gas industry.

One specific example of the "dry storage method" was illustrated by Wu in his U.S. Pat. No. 8,292,546. In this example, one liquid storage compartment is coupled with one water ballast compartment under a symmetrical arrangement with the existence of pressured inert gas above both liquid surface and the water surface in these two compartments. During oil loading and offloading operations, the system functions as an equal mass flow rate displacement system with a pair of coupled pumps by which a constant system mass is maintained and the COG is moved only along a vertical axis. The primary advantage of this system is that the whole system weight is constantly maintained during loading and offloading operations. However, this system gives rise to three concerns. Firstly, the oil storage volume utilization is low. More than 50% of the total system volume cannot be utilized for oil storage, but has to be left for containing seawater and inert gas. Therefore, a large amount of buoyancy will be still produced during oil loading and offloading operations (more than 50% in contrast to only about 15% in the "wet storage method" system). To overcome this buoyancy issue, a heavy concrete structure usually has to be utilized, instead of using steels which are commonly used for offshore platform constructions. Secondly, both liquid storage compartment and water compartment have to be designed as pressured vessels because of the existence of inert gas. Thirdly, the system operation is heavily dependent on a complex system using a pair of coupled pumps for oil and for water separately. This arrangement could become a safety concern during the oil storage system operation.

Therefore, there is a need for a submerged offshore storage system that combines wet storage method and dry storage method, and maintains advantages and overcomes disadvantages of these two storage methods.

SUMMARY OF THE INVENTION

A new submerged oil storage system is disclosed. The disclosed submerged oil storage system achieves the following objectives:

1. The submerged oil storage system maintains the key advantages of the "dry storage method," such as having no physical contact between oil and water, providing good thermal insulation to ensure optimal fluidity of the stored oil, and capability of storing water-soluble liquids like methanol. At the same time, the system overcomes the disadvantages typical of the "dry storage method", e.g., using inert gas and producing excessive buoyancy during offloading operations;

2. The submerged oil storage system maintains as a hydrostatically balanced system independent of water depth, which is similar to a "wet storage method" system. Therefore, the oil storage tank does not need to be designed as a pressured vessel. The maximum difference of the storage tank on-bottom weight difference (maximum one minus the minimum one) should be usually less than 20% of the maximum storage capacity;

3. The system storage capacity is fully utilized for oil or hydrocarbon liquids without a separate water storage tank within the system. In addition, no paired pumps are needed to deal with the loading and offloading of oil and water at the same time.

In accordance with one embodiment, the oil storage, loading and offloading system includes a submerged oil storage tank with multiple vertically placed flexible containers. The oil storage system directly connects to the topsides of an offshore oil production platform above water to assist the platform oil loading and oil offloading process. During the loading operation, oil is pumped in and stored inside each flexible container, which is expanded to displace the equivalent amount of water out; during the offloading operation, oil is pumped out from each flexible container, which contracts accordingly, and the reduced volume of each contracted container is then filled in by the equivalent amount of water from the surroundings.

One application of the disclosed oil storage system is for a shallow water marginal oil field development. With the advantages of the disclosed oil storage system, many marginal fields could be developed economically to overcome the several key challenges that commonly exist.

Another application using the disclosed oil storage system is to add oil storage, loading and offloading capabilities to deepwater floating platforms, such as a SPAR or a SEMI structure.

BRIEF DESCRIPTION OF THE DRAWINGS

The drawings described herein are for illustrating purposes only of selected embodiments and not all possible implementations, and are not intended to limit the scope of the present disclosure. For further understanding of the nature and objects of this disclosure reference should be made to the following description, taken in conjunction with the accompanying drawings in which like parts are given like reference materials, and wherein:

FIG. 2-1 illustrates a cross section view of the vertically placed flexible container taken along line AA' in FIG. 2;

FIG. 5-1 illustrates a cross section view at the top surfaces of 4 support pads of the wellhead platform taken along line AA' in FIG. 5;

FIG. 9-1 illustrates a cross section view at the top of the oil storage tank taken along line AA' in FIG. 9;

FIG. 13B-1 illustrates a cross section view at the top of one submerged oil storage tank taken along line AA' in FIG. 13B;

FIG. 14A illustrates a front view of a prior art of a conventional truss SPAR platform for oil drilling and production without oil storage facility;

FIG. 14B illustrates a front view of the truss SPAR platform for oil drilling and production with one embodiment of the addition of one submerged oil storage tank below the hard tanks;

FIG. 15-1 illustrates a cross section view of the middle of one submerged oil storage tank taken along line AA' in FIG. 15.

DETAILED DESCRIPTION OF THE EMBODIMENTS

Before explaining the disclosure in detail, it is to be understood that the system and method is not limited to the particular embodiments and that it can be practiced or carried out in various ways. It is also to be understood that the submerged oil storage tank system and method disclosed herein may be used in any body of water. The term "oil" may comprise crude oil and other hydrocarbon liquids. The term "water" may refer to seawater or fresh water.

Figure 1:
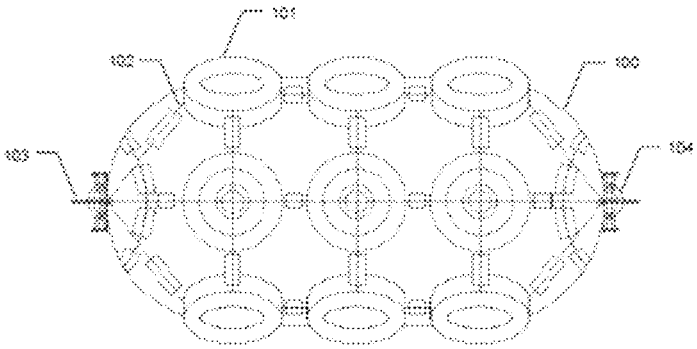
FIG. 1 (Prior Art)
FIG. 1 illustrates a side view of a prior art of a horizontally placed pneumatic fender.

FIG. 1 illustrates a side view of a conventional floating pneumatic fender 100 in a horizontal position. Floating fenders 100 are commonly used to absorb dynamic impact forces between a jetty and a vessel side, and, in naval applications, between two vessel sides. A conventional floating pneumatic fender 100 is usually composed of three layers:

(1) The outer layer consists of used tires 101, chains 102, a valve 103 and two towing rings 104 with one such ring at each end. The purpose of this layer is to protect the layer beneath against friction induced wearing. Impact loading by induced friction force at the tires 101 surfaces should be passed to the towing rings 104 at both ends of the fender 100 through these chains 102;

(2) The second layer is composed of rubber material and several layers of fiber nets such as polyester nets, which are bonded together through a vulcanization process. The same vulcanization process should also bond this layer to the steel surfaces of the two towing rings to form a sealed room inside the fender 100;

(3) The third layer is composed of a thin layer of rubber or synthetic materials for the purpose of air sealing, so that the pneumatic fender 100 can maintain its designed air pressure throughout its service life with a need for only a few air pressure adjustments.

The larger a pneumatic fender 100, the more energy absorption capacity it will possess. At the time of this disclosure, a large pneumatic fender 100 can have a size of 6 meters (about 20 feet) in O.D.×12 meters (about 40 feet) in length. If the large sealed internal room of such pneumatic fender 100 is utilized as a flexible container, each one can provide a large storage capacity of more than 300 cubic meters for oil storage.

Figure 2:
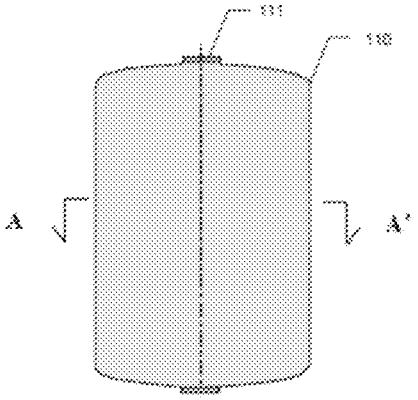
FIG. 2 illustrates a side view of a vertically placed flexible container in accordance with one embodiment.
Figures 1, 2:
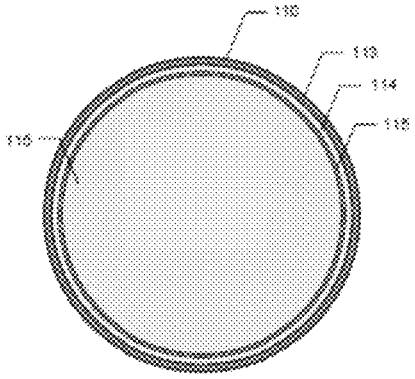

Referring now to FIG. 2. FIG. 2 illustrates the side view of a vertically placed flexible container 110 disclosed herein. In one embodiment, the flexible container 110 has a shape similar to the conventional floating pneumatic fender 100 in FIG. 1 without the outer protective layer (e.g. used tires 101). The vertically placed flexible container 110 has a flange structure 111 at the bottom and the top respectively, intended to be fixed with the two matching structures of the corresponding steel compartment.

FIG. 2-1 illustrates the cross section A-A' view of the flexible container 110. As shown in FIG. 2-1, the flexible container 110 has three layers:

1) The outer layer 113 composed of rubber material and several layers of fiber nets such as polyester nets bonded together through vulcanization. It is worth pointing out that since it does not need to stand huge impact force as in the case of a pneumatic fender, thickness of the component layers of a flexible container can be significantly reduced. Such reduction will bring up two benefits: a) cost reduction; and b) increased flexibility to enable the flexible container to expand or contract more easily during loading and offloading of oil. The same vulcanization process should also bond this layer 113 to steel surfaces at these flanges 111 to form a sealed room for the flexible container 110;

2) The second layer 114 for thermal insulation; and

3) The third layer 115 composed of a thin rubber sheet or a sheet of synthetic materials for the purpose of air sealing. If needed, one more specially made thin layer could be glued to the inner surface of the third layer 115 against potential chemical corrosion by processed oil. Inside the third layer is the storage room for storing oil 116. It is worth mentioning that rubber itself is an excellent thermal insulation material. With the addition of one extra layer of thermal insulation material, the flexible container 110 should possess even better thermal insulation property.

Figure 3A:
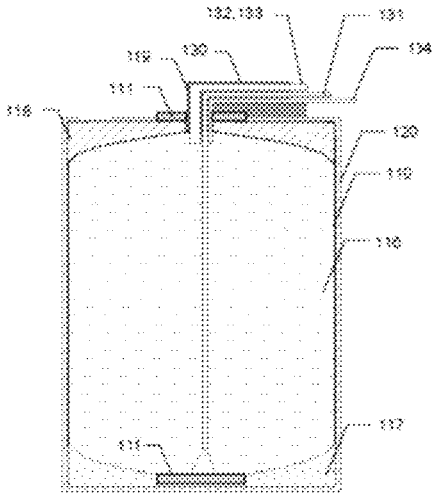
FIG. 3A illustrates a sectional view of a hexagon-shaped steel compartment with a flexible container inside, and the flexible container is full of stored oil.

FIG. 3A illustrates a cross section view of one embodiment of the flexible container 110 inside a hexagon-shaped steel compartment 120 fully loaded with oil 116 in accordance with one embodiment. It is recommended that each steel compartment 120 and its flexible container 110 should be so designed and built that when fully loaded with oil the flexible contained will squeeze hard against the inner surface of the steel compartment 120 to create an oxygen-free environment. Such environment will make it difficult for any marine life, barnacles in particular, to live or grow. Finally, it should be pointed out that the walls of each steel compartment does not need to be solid; instead, they can be an open structure made of narrow pieces of steel plate, as long as the compartment is structurally strong enough. Such configuration can reduce the overall weight of the oil storage tank as well as the cost.

Flange 111 connections located at both the top and the bottom of the flexible container 110 are used to connect the flexible container 110 to the steel compartment 120. The top of steel compartment 120 may be opened for repair or replacement of the flexible container 110 inside through the top flange 111. At the top of the flexible container 110, there is a curved structure 118 of the compartment 120 designed to take the pressured loading from the flexible container 110 top portion when the container 110 is full of oil 116. The interconnection piping set 130 passes through the top flange 111. There are 5 smaller pipes inside the interconnection piping set 130: one pair of longer pipes 131 for hot liquid (water or oil) circulation to keep the stored oil warm to ensure optimal fluidity; pipe 132 for oil importing and exporting; pipe 133 for air injection and release; and pipe 134 for providing sensors, such as pressure and temperature sensors inside each flexible container 110. This piping set 130 should be interconnected between the topsides and every flexible container 110 in the system. The inside wall of this connecting pipe 130 should be lined with conventional thermal insulation material 119.

One venting hole 140 at the top of each steel compartment 120 is for releasing potentially trapped air at the top of the compartment 120. During the transportation and the lowering operation, these venting holes 140 are to be closed. The flexible containers 110 should be injected with air for the sake of safety and necessary buoyancy. These venting holes 140 should also be closed prior to the submergence of the compartment 120 top surface under water. During the lowering, the tank 200 should be flooded with seawater, air should be vented through a designed venting line and air inside these flexible containers 110 should be gradually reduced accordingly. Once fully loaded with oil 116, there is only a small amount of seawater 117 left at the bottom of the steel compartment 120, as shown in FIG. 3A.

Figure 3B:
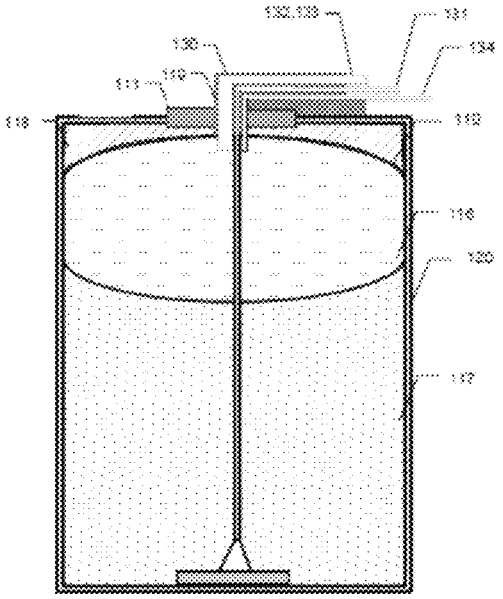
FIG. 3B illustrates a sectional view of a hexagon-shaped steel compartment with a flexible container inside, and the flexible container is partially filled with stored oil.

FIG. 3B is a cross section view of the flexible container 110 partially filled with oil 116 inside a hexagon-shaped steel compartment 120 in accordance with one embodiment. A large amount of imported seawater 117 is located at the bottom of the steel compartment 120 to fill the room emptied by the exported oil 116 volume. The bottom portion of the flexible container 110 should be squeezed to become near flat by water pressure, and the remaining oil 116 inside the container 110 is pushed upward by the pressure of the surrounding seawater 117.

Figure 4A:
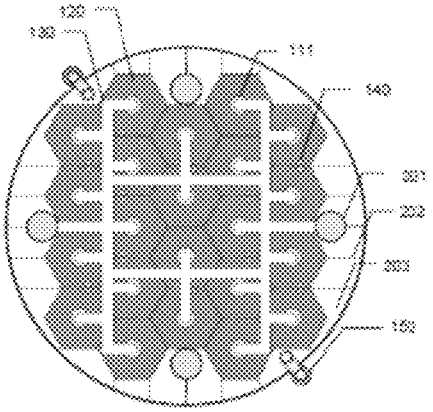
FIG. 4A illustrates a top view of one embodiment of honeycomb-like steel oil storage tank with 22 hexagon-shaped steel compartments and an interconnected piping system to connect all the flexible containers inside these compartments.
Figure 4B:
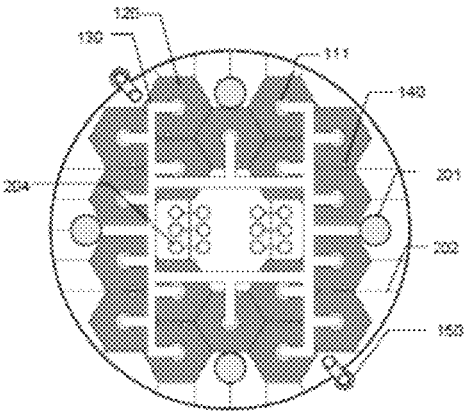
FIG. 4B illustrates a top view of another embodiment of honeycomb-like steel oil storage tank with 18 hexagon-shaped steel compartments, 12 well conductor guides at tank center, and an interconnected piping system to connect all the flexible containers inside these compartments.
Figure 4C:
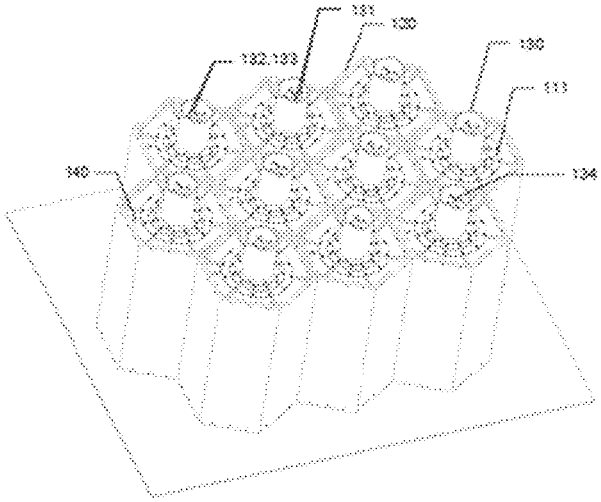
FIG. 4C illustrates an isometric view of 10 hexagon-shaped steel compartments and the details at the top of each compartment.

FIGS. 4A-4C illustrate embodiments of an oil storage tank with different configurations.

FIG. 4A is a top view of an oil storage tank 200 in accordance with one embodiment. The oil storage tank 200 has four tubular leg members 201 connecting the submerged tank 200 and the topsides above. The oil storage tank 200 contains twenty-two hexagon-shaped steel compartments 120 with one flexible container 110 inside each steel compartment 120. It may be necessary to apply an antifouling coating to the inner surface of each compartment 120 in order to prevent formation of sharp-edged marine growths, or barnacles, which might cause damages to the flexible container 110 over time. At the time of this disclosure, there are some off-the-shelf materials that may be used for this coating. These off-the-shelf materials used for antifouling coating possess these properties: high efficacy, lasting effectiveness, non-toxicity and environmental friendliness.

Another known existing method is to generate sodium hypochlorite in water via an electrolytic process, which can effectively prevent any marine growth. Since seawater inside the oil storage tank 200 is relatively isolated and stable, it is easy to keep an effective concentration level of sodium hypochlorite in the tank 200. This is also known as an effective, economical, and environmentally friendly method. It should be pointed out that as times goes by, even better antifouling solutions may become available.

Two pipes 150 are equipped with one end going along the outside surface of the tank 200 to the bottom part of the tank 200 and with the other end reaching the inside of the tank 200 for intake and expelling of seawater. The reason for such arrangement is that the deeper the seawater, the less seeds of barnacles and less oxygen contents in seawater there will be. Furthermore, filter(s) can be installed at the mouth of the pipes 150 to keep seeds of barnacles or any other moving objects out and to let only seawater 117 in.

In another embodiment, at the mouth of these two pipes 150, one-way check valves, one for each, are installed to only allow the seawater to flow in one direction, whether in or out. During the oil loading process to pump water, displaced seawater should be pumped to a water monitoring/processing vessel at the topsides to ensure water's cleanness before being discharged to the sea. This oil loading process is a long process and the size of this water monitoring/processing vessel should be a reasonable one.

To sum up, there are four lines of defense against formation of sharp-edged barnacles inside a steel compartment 120 housing the flexible containers 110. First, the mouth of the water tubes 150 should be located at the lower part of the submerged oil tank 200 to take in and expel seawater, in order to decrease the chances for sucking in seeds of various barnacles. Second, these openings should be covered with filter or filters to keep out various moving objects in seawater including seeds of barnacles. Third, the steel compartment 120 and its flexible container 110 should be properly designed and built so that once full loaded, the flexible container 110 will squeeze hard against the inner surface of the compartment 120, thus creating an oxygen-free environment, which is hostile to marine life including barnacles. Fourth, the antifouling coating or chemicals may be applied. Finally, absence of sunlight inside the submerged oil tank 200 makes it a hostile environment for marine life, thus leaving very little, if any, nutritional food for barnacles to live or grow with. In actual application, any single one method or a combination of some or all listed above should be considered.

An interconnected piping system 130 is utilized to connect all the twenty-two flexible containers 110 and to pass through two of the four tubular leg members 201 to the topsides above. The reason for using two legs instead of only one is that one is used for backup for safety reasons. Multiple steel plates 202 are used to connect these compartments 120 with the tank 200 inner surface.

During the loading and offloading operations, oil 116 should be able to flow evenly into or out of all the individual flexible containers 110 simultaneously because of the existence of evenly distributed hydrostatic water pressure inside all the compartments 120.

The interior space of the compartment 120 provides an ideal place for rubber material such as the flexible container 110 because it has no exposure to sunlight and has a constantly low temperature, with both of the factors constituting a well suitable environment for the flexible container 110. It is worth noticing that absence of sunlight inside the submerged oil tank makes it a hostile environment for marine life, thus leaving very little, if any, nutritional food for barnacles to live or grow with. In addition, there is little impact loading to the flexible container 110 except for a limited number of expansions and contractions of the flexible container 110 during the oil loading and offloading operations causing some fatigue damage to the rubber material of the flexible container 110 over time. Therefore, the service life of the flexible container 110 is expected to be long.

The integrated honeycomb-like steel compartments 120 with steel plates 202 not only provide a protected room for each vertically placed flexible container 110, but also provide structural reinforcement to the circular-shaped steel tank 200. The tops of these empty compartments 203 should be covered with steel plates (not shown) in their service conditions. At the bottom of these compartments 120 structure, there should be holes to let seawater 117 flows freely from one compartment 120 to another.

FIG. 4B is a top view of an oil storage tank 200 in accordance with another embodiment. The tank 200 has 4 tubular leg members 201 and eighteen compartments 120 for eighteen flexible containers 110. Twelve well conductor guides 204 are placed at the center of the top of the tank 200 and two pipes 150 for seawater 117 in or out are placed to the sides of the tank 200.

FIG. 4C is an isometric cut-off view of the submerged oil storage tanks 200 with ten interconnected hexagon-shaped steel compartments 120 with one flexible container inside each in accordance with yet another embodiment. FIG. 4C also illustrates the positional relationship among the connecting pipes 130, the venting holes 140 for air in and out, the compartments 120, the hot liquid circulation pipes 131, the pipe 132 for oil loading and offloading operation, the air injection and release pipe 133, the pipe 134 for placing sensors and the flanges 111 at the compartments' 120 top.

One application of the disclosed oil storage system is for a shallow water marginal oil field development. A marginal oil field commonly refers to one which cannot be economically developed with conventional development methods such as using subsea pipelines. With the advantages of this disclosed system, many marginal fields could be developed economically to overcome the several key challenges that commonly exist:

(1) The number of oil wells of a marginal field platform is typically small, e.g., 3 to 8, and a wellhead platform for drilling and well completion activities should be installed several months ahead of the arrival of a production topsides; the drilling operation is usually conducted by a self-elevated drilling platform standing by the wellhead platform side;

(2) The service life is short, typically only 5~8 years, while a typical offshore steel platform service life is about 20~30 years.

Therefore, an economically feasible platform equipped with an oil storage system should be able to achieve the following objectives:

(a) Ability to be installed at one field site easily, and also to be removed and re-install at another field site without a need for an offshore crane vessel or any other major offshore transportation vessels.

(b) The platform should be able to adjust itself for different water depths and different soil conditions of any two different oil fields.

(c) The platform should be able to have a fender system to provide a safe and reliable fending protection for offshore docking by an oil shuttle tanker.

FIGS. 5-8 illustrate embodiments of a wellhead 300 during different stages of site installation.

Figure 5:
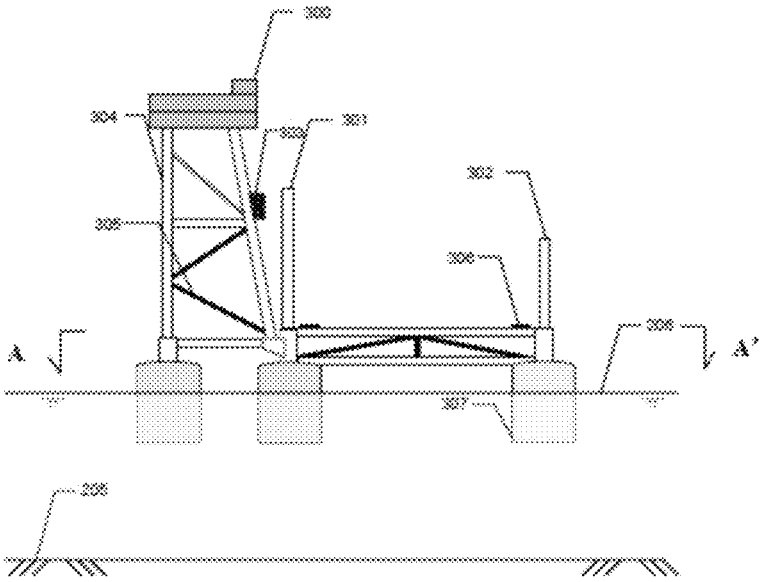
FIG. 5 illustrates a profile view of a wellhead platform in a floating condition having 5 suction piles with compressed air inside, just arriving at an installation site in preparation for the installation.
Figures 1, 5:
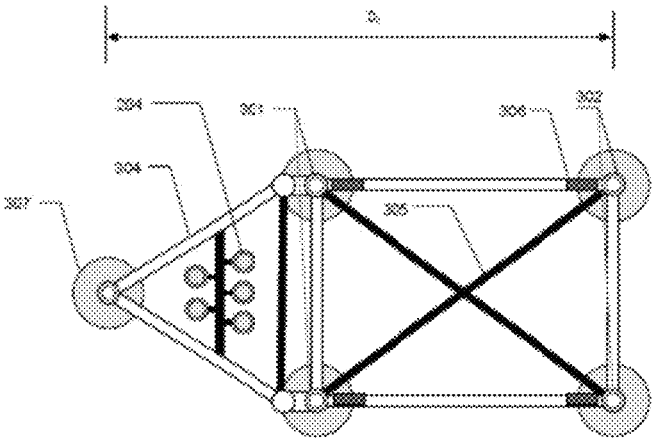

FIG. 5 is a profile view of a wellhead platform 300, in a floating condition ready for installation, for a marginal field application in accordance with one embodiment. The wellhead platform 300 is composed of five fixings 307, which could be in the form of suction piles (as shown) or foundation piles, to fix the platform 300 to the seabed 205 and to provide a support foundation with four pads 306 to a submerged oil storage tank 200; a fender 303 for the docking operation between the wellhead platform 300 and a floating oil storage tank 200; tubular members 304 and brace members 305; two high vertical posts 301 with the tops above water surface 206, and two low vertical posts 302 with the tops below water surface 206. These two pairs of posts, 301 and 302, are used for the purpose of positioning during the vertical docking operation between the wellhead platform 300 and the floating oil storage tank 200, and also as the stabilizers for the lowering operation of the submerged oil storage tank 200 in a floating condition.

During transportation, a control panel (not shown) may be installed at the deck of the wellhead platform 300 with soft hoses to connect individually these five suction piles 307 for air injection and release. A remote control device may be used to operate the control panel from the vessel deck of a towing tug.

FIG. 5-1 is the cross section A-A' view of wellhead platform 300 in FIG. 5 just above the top of the four supporting pads 306. As shown, the wellhead platform 300 comprises five suction piles 307, tubular members 304, brace members 305, five well conductor guides 204, and four post members 301, 302. The suction piles 307 take the environmental loadings for the wellhead platform and for the oil storage tank 200 during the service life. The distance ($D_0$) from the center of the front suction pile 307 to the center of the rear suction piles 307 is an important factor in determining the stability of the wellhead platform 300 during its transportation and installation. In general, the longer the distance of $D_0$, the more stable for the wellhead platform 300 transportation and installation. A reasonable distance of $D_0$ should be longer than the water depth at the installation site.

Figure 6:
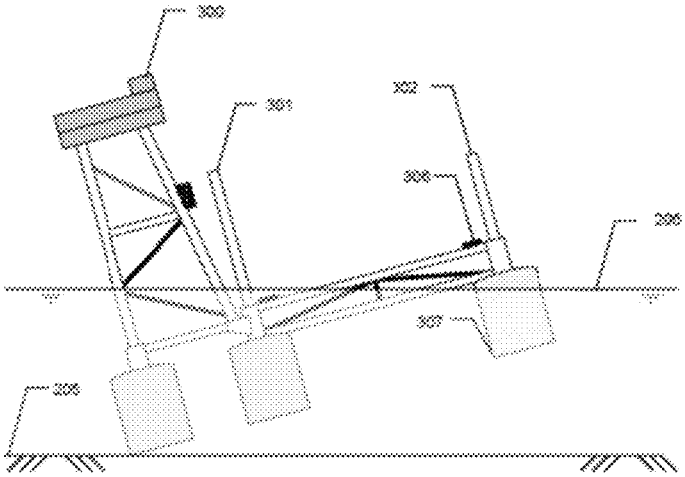
FIG. 6 illustrates a profile view of the floating wellhead platform during a site installation with the front suction pile touching the seabed.

FIG. 6 is a profile view of the floating wellhead platform 300 during a shallow water site installation in accordance with one embodiment. During transportation, five suction piles 307 are full of compressed air to provide the buoyancy for the floating platform 300. During the installation, air will be gradually released from selected suction piles 307 to enable the front pile 307 to touch the seabed 205 smoothly, and to provide the needed stability for the lowering operation of the wellhead platform 300.

Figure 7:
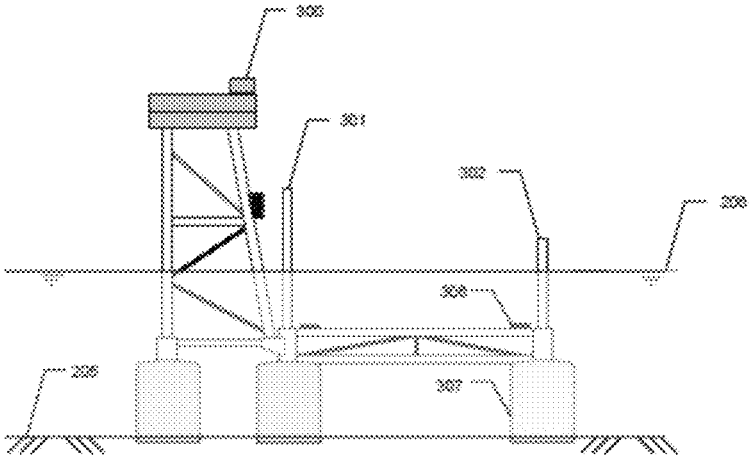
FIG. 7 illustrates a profile view of the wellhead platform during a site installation with all the 5 suction piles sitting at seabed.

FIG. 7 is another profile view of the wellhead platform 300 during a shallow water site installation. With the air releasing selectively from the five suction piles 307, the platform 300 is lowered and evenly sits at seabed 205. Air from these five suction piles 307 should be completely released and replaced by seawater in the end. Limited penetrations of these suction piles 307 by gravity force should be expected.

Figure 8:
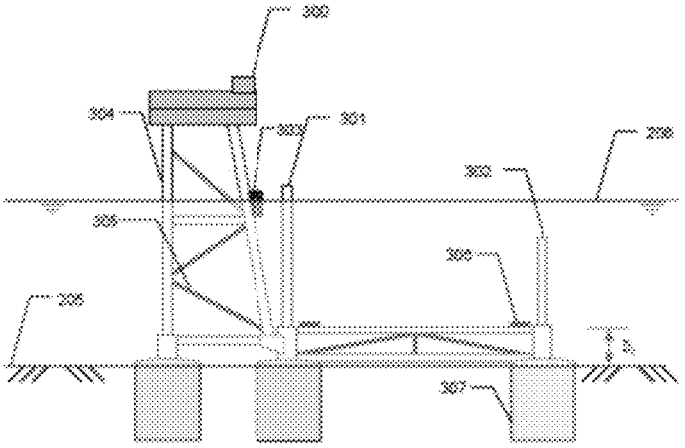
FIG. 8 illustrates a profile view of the installed wellhead platform.

FIG. 8 is a profile view of the installed wellhead platform 300. Pumps are used to pump water out from the suction piles 307 in order to drive the piles 307 to a designed penetration depth. The minimum height ($D_1$) between the tank 200 bottom and the seabed 205 should be large enough to avoid scoring effects. In one embodiment, $D_1$ is larger than 2 meters. This minimum height $D_1$ may be easily adjusted to suit different water depth and different soil conditions at a new marginal oil field site. These adjustment activities may be performed at a dry dock after the platform 300 is removed and transported to a dry dock for associated modifications. These modifications should include the adjustment of the distance $D_1$ to suit the new water depth and the modification of these suction piles 307 to suit the new soil condition at the new site, if needed.

The illustrated configuration for this wellhead platform 300 makes it self-installable without a need for a crane vessel or a transport vessel. The wellhead platform 300 could be installed several months prior to the arrival of the storage tank and the production topsides, because a drilling and well completion program could be performed first by a self-elevated drilling platform from one side of the installed wellhead platform 300.

Prior to the arrival of the oil storage tank 200, drilling and well completion activities should have been finished at the wellhead platform with conductors 307 installed.

Figure 9:
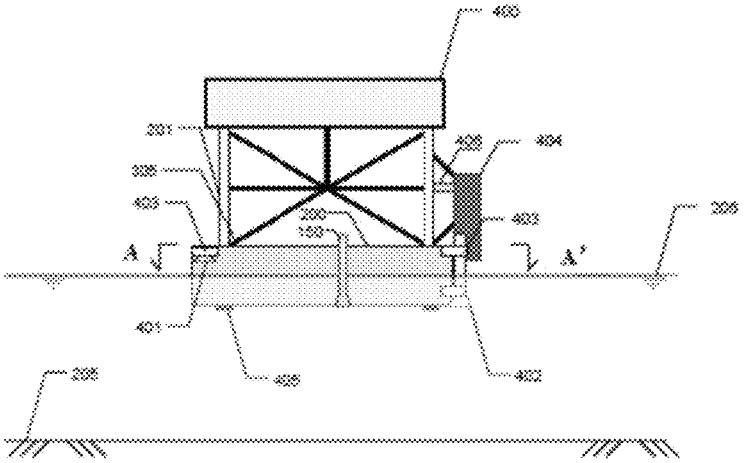
FIG. 9 illustrates a profile view of an oil storage tank in a floating condition connected with a production topsides above through four vertical legs.
Figures 1, 9:
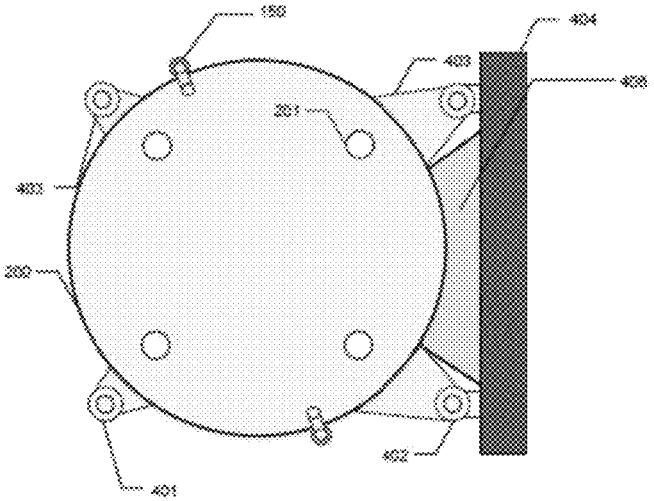

Referring now to FIG. 9, an oil storage tank 200 loaded with production topsides 400 in a floating condition ready for a site installation. This combined system of the tank 200 and the topsides 400 is composed of four leg members 201 plus braces 305 connecting the tank 200 and the topsides 400, two short sleeves 402 above water 206, two pipes 150 for seawater in and out of the tank 200, two long sleeves 401 with bottom parts below water surface 206 plus installed cone structures for the vertical docking purpose, york-plates 403 for the connections between the tank 200 and these sleeves 401 and 402, a fender system 404 with connecting plates 406 between the fender system 404 and the leg members 201, and four supporting pads 405 at the tank 200 bottom beneath the four leg members 201.

Combining the oil storage tank 200 and the topsides 400 together will provide many benefits, as follows:

(1) The oil storage tank 200 itself can be transported and self-installed with the topsides 400, there is no need to employ a crane vessel or a transport barge;

(2) The topsides 400 provides a sufficient weight to the submerged oil storage tank 200 so that the on-bottom weight at the tank 200 bottom is greater than the required minimum on-bottom weight during the loading and offloading operations;

(3) Two out of the four tubular leg members 201 and the tank 200 outer shell will be utilized to provide a strong support for the fender system 404.

For clarity purpose, FIG. 9-1 illustrates the cross section view at the top of the oil storage tank 200 without the interconnected piping system 130. As shown, there are four sleeves 401/402, multiple york-plates 403, one set of connecting plates 406 and a fender system 404.

Figure 10:
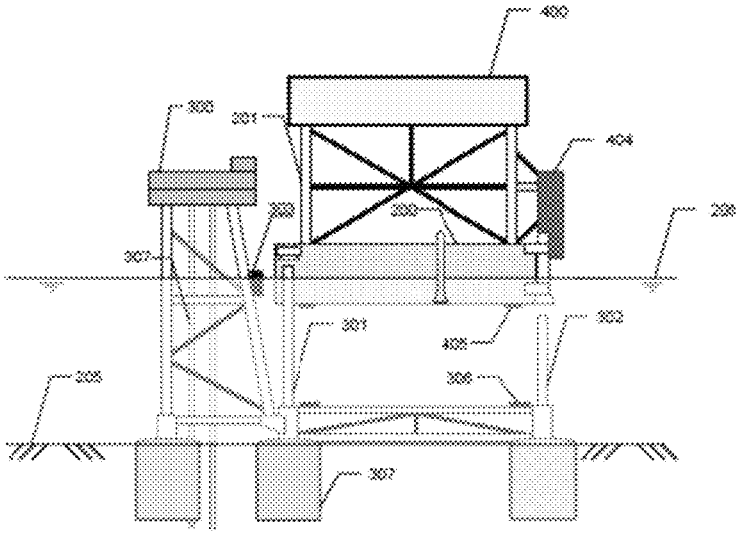
FIG. 10 illustrates a profile view of the floating oil storage tank in a vertical docking operation with the installed wellhead platform.

FIG. 10 is a profile view of an oil storage tank 200 loaded with production topsides 400 in preparation for a docking and lowering operation. A docking fender 303 is installed to provide the protection of the wellhead platform 300. Tides should be calculated to select the best timing to commence the vertical docking between the sleeves 401/402 and the posts 301/302, respectively. Tugs (not shown) should be utilized for the docking operation.

Figure 11:
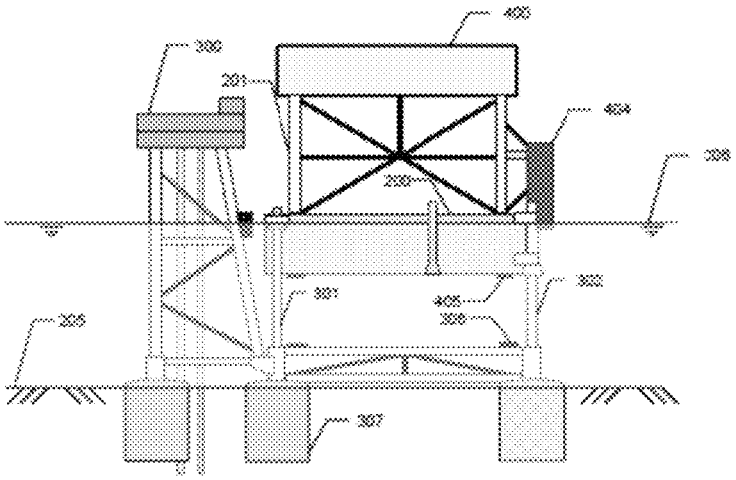
FIG. 11 illustrates a profile view of the floating oil storage tank connected with a production topsides above during a lowering operation onto the support pads of the installed wellhead platform.

FIG. 11 is a profile view of an oil storage tank 200 loaded with a production topsides 400 in the lowering operation after the completion of the vertical docking operation. Both sets of posts 301/302 are inside of sleeves 401/402, respectively, before the top of the tank 200 being submerged below water surface 206. These sleeves 401/402 and the posts 301/302 provide stability for the floating tank 200 during the lowering operation.

To reduce the buoyancy of the floating tank 200, some of these compartments 120 and empty compartments 203 will be ballasted and flooded in order to increase the draft of the floating tank 200. Other compartments 120 will be used as buoyant compartments with their associated flexible containers 110 being injected with air. In one embodiment, before the top of the tank 200 is submerged, all venting holes 140 at the tank 200 top should be open. During the lowering process after the top of the tank 200 is submerged below water surface 206, air from these selected containers 110 should be released in a controlled manner to lower the floating tank 200 slowly until the pads 405 sit on the tops of pads 306. After the installation, air should be totally released from these containers 110, with some suction action if necessary, before commencing oil storage activities.

For the removal of the oil storage tank 200 for a new oil field development, after oil 116 are pumped out of all of the flexible containers 110, air will be injected into the flexible containers 110 to displace the water 117 out of these steel compartments 120, as a result, lifting the tank 200 to the water surface 206. With additional de-ballasting action from these empty compartments 203 and the proper utilization of tides, the tank 200 can be easily moved out of the site with the help of tugs.

Figure 12:
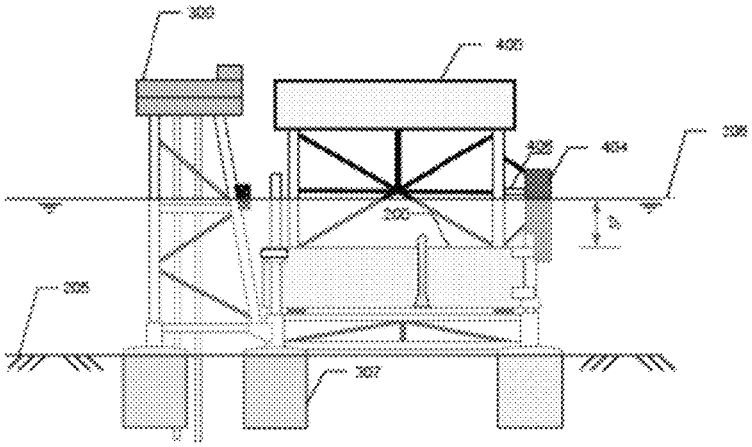
FIG. 12 illustrates a profile view of the installed configuration at the site with the completion of docking and lowering operations between the submerged oil storage tank and the wellhead platform to form a complete drilling and oil production platform.

FIG. 12 illustrates a fixed drilling, production, oil storage and offloading platform utilized for a shallow water oil field development, including wellhead platform 300, oil storage tank 200 and production topsides 400.

The whole platform is divided into two substructures: the wellhead platform 300 and the combined structure of the oil storage tank 200 and the production topsides 400. One of the primary reasons for such division is for each structure to perform its own function. For the wellhead platform 300, it is an adjustable structure to suit different water depths and different site soil conditions. For the production topsides 400, it could be a standardized structure configuration suitable for the whole region applications as long as the wave conditions are identical throughout the region. Some modifications or replacements might be needed for the topsides equipment, if required by next installation.

There should be sufficient on-bottom weight at the tank 200 bottom. The combined structure with the tank 200 and the topsides 400 functions as a gravity based structure sitting on the foundation provided by the wellhead platform 300, without a need for welded connection between the two structures.

Selection of the distance ($D_2$) between water surface 206 and the tank 200 top is dependent on potentially encountered maximum wave height ($H_{max}$) during the platform service life in the region. Typically, the minimum value of $D_2$ should be larger than half of the value of $H_{max}$ in order to minimize the wave induced loading to the combined structure.

The site removal operation of both wellhead platform 300 and oil storage tank 200 should be the reverse of the installation of these structures to make them self-removable structures without a need for a crane vessel or any major transportation vessels. After the site removal operations, these structures could be moved to a dry dock for required modifications to suit the next marginal field development.

To summarize, the disclosed oil storage system can be utilized for the application of a shallow water marginal field development. The oil storage tank 200 provides the function as a submerged oil storage system to minimize the wave induced loading. The oil storage tank 200 may also be transported independently and self-installed to eliminate the need for a crane vessel or a transport vessel during the installation. These characteristics of the oil storage tank make the combined structure of the oil storage tank and production topsides self-installable and self-removable, with the flexibilities to suit the potential modification requirements for different marginal field developments. The method disclosed herein also provides a way for easy installation, easy removal and easy re-installation of the system for multiple consecutive applications, which best suits multiple developments of marginal oil fields in the same region.

Figure 15:
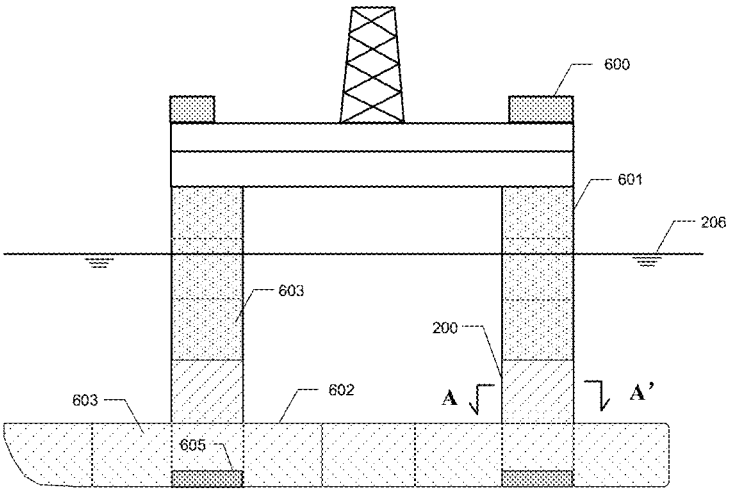
FIG. 15 illustrates a profile view of a floating semi-submersible (SEMI) platform for oil drilling and production with one embodiment of four submerged oil storage tanks located at the bottoms of the four columns.
Figures 1, 15:
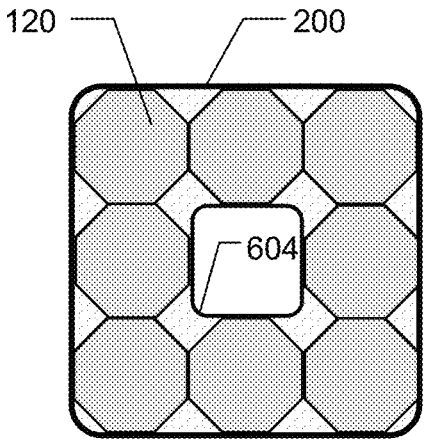

The disclosed oil storage system may be easily implemented to deepwater floating structures such as a conventional SPAR 500, a truss SPAR 510 or a SEMI 600 with little inference to the basic characteristics of these floating structures. FIGS. 13-15 illustrate various embodiments of applications of oil storage tank disclosed herein.

Figure 13A:
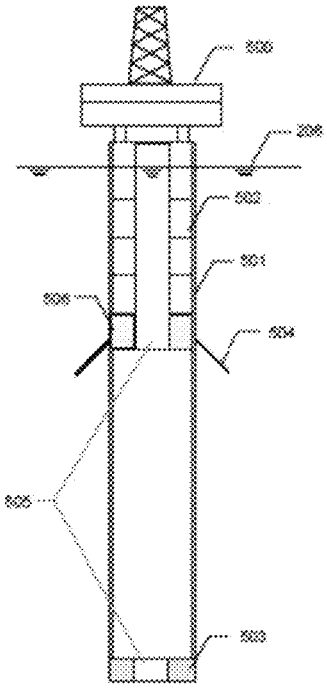
FIG. 13A (Prior Art)
FIG. 13A illustrates a front view of a prior art of a conventional floating SPAR platform for oil drilling and production without oil storage.

FIG. 13A illustrates a front view of a conventional floating SPAR platform 500 for offshore oil drilling and production. The draft hull 501 usually has a length of about 200 meters (650 feet) below water surface 206. There are several levels of hard tanks 502 with a center well 505 in the upper portion of the draft hull 501. At the bottom of the hard tanks 502, there are ballast tanks 506 and a set of mooring system 504. At the bottom of the draft hull 501, there are soft tanks 503 and a center well 505. Inside the middle section of the draft hull 501, it is totally flooded. Conventional SPAR does not contain oil storage capability based on the current field applications.

Figure 13B:
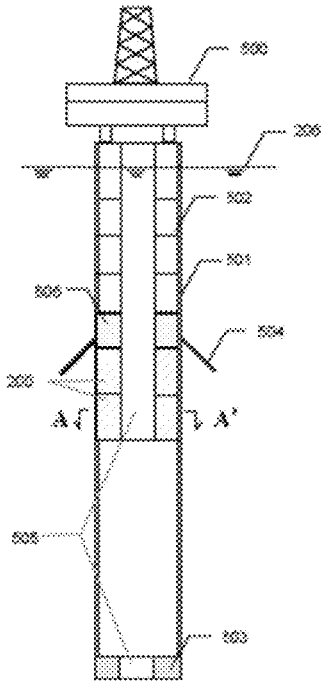
FIG. 13B illustrates a front view of the conventional floating SPAR platform for oil drilling and production with one embodiment of the addition of two submerged oil storage tanks at the middle section below hard tanks.
Figures 1, 13B:
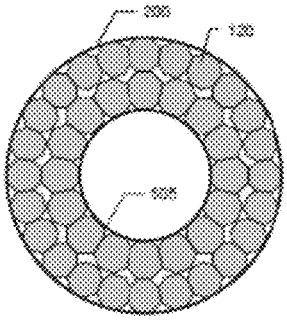

FIG. 13B illustrates a floating SPAR platform 500 modified to possess oil storage capability by adding two oil storage tanks 200.

FIG. 13B-1 is the cross section view of the oil storage tank 200 in FIG. 13B along line AA'. Multiple modified octagon-shaped steel compartments 120 are placed between the tank 200 inner surface and the center well 505 outer circular surface to form the oil storage system. During the loading and offloading operations, the oil storage system will produce limited buoyancy variation, and the existing ballast system in the SPAR 500 should be able to compensate for such small buoyancy variation.

FIG. 14A illustrates a front view of a conventional floating truss SPAR platform 510 for offshore oil drilling and production. At the upper hull 511, there are several levels of hard tanks 512 with a center well 515. At the bottom of the hard tanks 512, there are ballast tanks 516 and a set of mooring system 514. At the bottom portion of the platform 510, there are soft tanks 513 and a center well 515. At the middle section of the platform 510, there is a truss structure 517 and several heave plates 518. Conventional truss SPAR does not contain oil storage capability based on the current field applications.

FIG. 14B illustrates a floating truss SPAR platform 510 modified to possess oil storage capability by adding an oil storage tank 200 under the ballast tanks 516. During the loading and offloading operations, the oil storage system will produce limited buoyancy variation, and the existing ballast system in the truss SPAR 510 should be able to compensate for such small buoyancy variation.

FIG. 15 illustrates a profile view of a semi-submersible (SEMI) floating structure 600 for offshore oil drilling and production. There are four columns 601 with multiple levels of hard tanks 603, two pontoons 602 with multiple hard tanks 603 and with multiple ballast tanks 605. Four oil storage tanks 200 disclosed herein are added to the bottom of the columns 601 to provide the SEMI 600 with oil storage capability.

FIG. 15-1 is the cross section view of the oil storage tank 200 along line AA'. Eight octagon-shaped steel compartments 120 are placed side by side with a passage way 604 at the center. During the loading and offloading operations, the oil storage system 200 will produce limited buoyancy variation, and the existing ballast system in the SEMI 600 should be able to compensate for such small buoyancy variation.

Although preferred embodiments of a submerged oil storage system in accordance with the present invention has been described herein, those skilled in the art will recognize that various substitutions and modifications may be made to the specific features described without departing from the scope and spirit of the invention as recited in the appended claims.

What is claimed is:

1. A submerged oil storage and off-take system for a fixed offshore platform, comprising:

a topsides for oil production positioned above water surface;

an underwater storage tank for oil and water storage, with a preset minimum submerged distance between the water surface and the top of the tank, connected to the topsides with a plurality of leg members, wherein the storage tank comprises a plurality of non-sealed vertical compartments, each vertical compartment houses one vertically placed flexible container for oil storage, with the remaining room of the compartment for water storage, without any physical contact between oil and water, the flexible container is fixed with the vertical compartment both at top and at bottom;

a pre-installed foundation between seabed and the bottom of the storage tank to provide a support for the storage tank, the foundation connected with the seabed with a plurality of fixings, and the foundation to be installed prior to the arrival of the storage tank; and a plurality of grouped communication channels connected at one end with each flexible container and at the other end with the topsides above the water surface; at least one fluid channel with one end positioned outside the tank to interface with surrounding water and with the other end positioned inside the tank.

2. The submerged oil storage and off-take system according to claim 1, wherein the vertical compartment has a polygonal cross-section shape.

3. The submerged oil storage and off-take system according to claim 1, wherein the pre-installed foundation is a truss structure with a height between the bottom of the storage tank and the seabed.

4. The submerged oil storage and off-take system according to claim 1, wherein the plurality of fixings connecting the foundation to the seabed are either suction piles or foundation piles.

5. The submerged oil storage and off-take system according to claim 4, wherein the distance between a front fixing and a rear fixing is larger than the water depth at the site.

6. The submerged oil storage and off-take system according to claim 3, wherein the height of the truss structure between the bottom of the storage tank and the seabed is taller than 2 meters.

7. The submerged oil storage and off-take system according to claim 1, wherein the preset minimum submerged distance is larger than half of the maximum wave height that the platform could ever encounter during a service life of the platform.

8. The submerged oil storage and off-take system according to claim 1, wherein the grouped communication channels comprise a) a hot liquid circulation system, b) an oil loading and offloading system, c) an air injection and release system, and d) a system for placing sensors.

9. The submerged oil storage and off-take system according to claim 1, wherein the flexible container is a rubber bag composed of a plurality of layers:

a) a top layer composed of a plurality of sub-layers with rubber material and a plurality of fiber nets bonded together through vulcanization, b) a thermal insulation layer with thermal insulation materials, c) an air sealing layer composed of a thin rubber sheet or a sheet made of synthetic materials, and, d) a chemical protection layer composed of a thin sheet with anti-chemical corrosion property, which could be glued to the inner surface of the air sealing layer.

10. A drilling and oil production platform equipped with a submerged oil storage and off-take system for a shallow water field development, comprising:

a pre-installed wellhead platform to be installed prior to the arrival of a combined system having an oil storage tank and a topsides connected together in a vertical orientation, wherein the wellhead platform comprises — an adjustable support foundation with a deck above water and a plurality of well conductor guides for drilling purpose, a plurality of supporting pads at the top of the adjustable support foundation for supporting the combined system, a plurality of fixings at the bottom of the adjustable support foundation connecting the adjustable support foundation to seabed, and a docking fender installed on the adjustable support foundation and a plurality of vertical posts having fixed bottoms on the adjustable support foundation for vertical docking and lowering operations of the combined system;

the combined system with the oil storage tank docked on the adjustable support foundation of the wellhead platform, wherein the oil storage tank comprises a plurality of non-sealed vertical compartments, each vertical compartment houses one vertically placed flexible container for oil storage, with remaining room for water storage, without any physical contact between oil and water, each flexible container is fixed with the vertical compartment both at top and at bottom;

a plurality of sleeves installed at the storage tank outer surface for the tank vertical docking and lowering purpose;

a plurality of grouped communication channels connected at one end with each flexible container and at the other end with the topsides above water surface; and at least one fluid channel with one end positioned outside the tank to interface with surrounding water and with the other end positioned inside the tank;

wherein the pre-installed wellhead platform and the combined system are integrated through a set of installation procedures without a need for use of a crane vessel or a transport vessel, the set of installation procedures comprise — a) transportation—the storage tank functioning as a transportation vessel for the transportation of the combined system in a vertical orientation, having a plurality of the flexible containers full of injected air as individual intact compartments to provide the damaged stability of the tank during the transportation, b) site vertical docking—utilizing tugs for alignment of each pair of the sleeve and the post, and utilizing ballasting to the tank and the air releasing from selective flexible containers during the vertical docking, and c) lowering and integration—continuing the ballasting and air releasing actions to lower the tank onto the support foundation until the completion of the integration between the pre-installed wellhead platform and the combined system.

11. The drilling and oil production platform equipped with a submerged oil storage and off-take system according to claim 10, wherein the vertical compartment has a polygonal cross-section shape.

12. The drilling and oil production platform equipped with a submerged oil storage and off-take system according to claim 10, wherein the adjustable support foundation is a truss structure between the bottom of the storage tank and the seabed, and the support foundation is adjustable after the platform ceases service at one site location, and then the truss structure can be modified for another site application with different water depth and different soil condition.

13. The drilling and oil production and oil storage platform equipped with a submerged oil storage and off-take system according to claim 10, wherein the plurality of fixings connecting the support foundation to the seabed are either suction piles or foundation piles.

14. The drilling and oil production platform equipped with a submerged oil storage and off-take system according to claim 13, wherein the distance between a front fixing and a rear fixing is larger than the water depth at the site.

15. The drilling and oil production platform equipped with a submerged oil storage and off-take system according to claim 12, wherein the height of the truss structure beneath the tank is larger than 2 meters.

16. The drilling and oil production platform equipped with a submerged oil storage and off-take system according to claim 10, wherein at least one vertical post top is above water surface.

17. The drilling and oil production platform equipped with a submerged oil storage and off-take system according to claim 10, wherein the wellhead platform is a self-installable structure without a need for use of a transport vessel or a crane vessel during an installation.

18. The drilling and oil production platform equipped with a submerged oil storage and off-take system according to claim 10, wherein the combined system is a self-installable structure without a need for use of a transport vessel or a crane vessel during an installation.

19. The drilling and oil production platform equipped with a submerged oil storage and off-take system according to claim 10, wherein the grouped communication channels comprise — a) a hot liquid circulation system, b) an oil loading and offloading system, c) an air injection and release system, and d) a system for placing sensors.

20. The drilling and oil production platform equipped with a submerged oil storage and off-take system according to claim 10, wherein the flexible container is a rubber bag composed of a plurality of layers:

a) a top layer composed of a plurality of sub-layers with rubber material and a plurality of fiber nets bonded together through vulcanization, b) a thermal insulation layer with thermal insulation material, c) an air sealing layer composed of a thin rubber sheet or a sheet made of synthetic materials, and, d) a chemical protection layer composed of a thin sheet with anti-chemical corrosion property, which could be glued to the inner surface of the air sealing layer.

21. A submerged oil storage and off-take system, comprising:

a submerged storage tank coupled with a topsides above water surface, with a preset minimum submerged distance between the water surface and top of the tank, for storing oil and water together, the storage tank, having an one-way flow channel equipped with a check valve to stop free exchange passage between water inside the tank and surrounding water, comprises a plurality of non-sealed vertical compartments, each vertical compartment comprises one vertically placed flexible container for oil storage and a remaining room of the compartment for water storage, with no physical contact between oil and water inside the compartment, the flexible container is fixed with the vertical compartment both at top and at bottom;

a plurality of grouped communication channels having one end inside one of the plurality of flexible containers and the other end at the topsides above the water surface for oil loading and offloading purpose;

different fluid channels with one end positioned inside the tank and the other end positioned outside the tank, utilized for the water inside the tank communicating in one-way flow with the surrounding water during oil loading and oil offloading operations, wherein a) during oil loading operations, displaced water inside the tank is pumped to a water monitoring/processing vessel at the topsides to ensure water's cleanness before being discharged to the surrounding water, and b) during oil offloading operations, a fluid channel equipped with a check valve to only allow the surrounding water to have a one-way flow into the tank; and a foundation beneath the storage tank to keep the bottom of the storage tank off seabed with a height between the seabed and bottom of the storage tank.

22. The submerged oil storage and off-take system according to claim 21, wherein the vertical compartments have a polygonal (hexagon, octagon, etc.) cross-section shape.

23. The submerged oil storage and off-take system according to claim 21, wherein the flexible container is a rubber bag composed of a plurality of layers.

24. The submerged oil storage and off-take system according to claim 21, wherein the preset minimum submerged distance is larger than half of the maximum wave height (Hmax) that the platform could ever encounter during its service life.

25. The submerged oil storage and off-take system according to claim 21, wherein the foundation is seabed.

26. The submerged oil storage and off-take system according to claim 21, wherein the grouped communication channels comprise a) a hot liquid circulation system, b) an oil loading and offloading system, c) an air injection and release system, and d) a system for placing sensors.

27. The submerged oil storage and off-take system according to claim 21, wherein the flexible container is a rubber bag composed of a plurality of layers:

a) a top layer composed of a plurality of sub-layers with rubber material and a plurality of fiber nets bonded together through vulcanization, b) a thermal insulation layer with thermal insulation materials, c) an air sealing layer composed of a thin rubber sheet or a sheet made of synthetic materials, and, d) a chemical protection layer composed of a thin sheet with anti-chemical corrosion property, which could be glued to the inner surface of the air sealing layer.

* * * * *